US009045969B2

(12) United States Patent
Waters et al.

(10) Patent No.: US 9,045,969 B2
(45) Date of Patent: Jun. 2, 2015

(54) MEASURING PROPERTIES OF LOW PERMEABILITY FORMATIONS

(75) Inventors: George Waters, Oklahoma City, OK (US); Ahmad Latifzai, Katy, TX (US); Edward C. Boratko, Sugar Land, TX (US)

(73) Assignee: Schlumberger Technology Corporation, Cambridge, MA (US)

( * ) Notice: Subject to any disclaimer, the term of this patent is extended or adjusted under 35 U.S.C. 154(b) by 676 days.

(21) Appl. No.: 12/207,554

(22) Filed: Sep. 10, 2008

(65) Prior Publication Data

US 2010/0058854 A1 Mar. 11, 2010

(51) Int. Cl.
*E21B 47/10* (2012.01)
*E21B 49/00* (2006.01)
*E21B 43/26* (2006.01)

(52) U.S. Cl.
CPC ..... *E21B 49/008* (2013.01); *E21B 43/26* (2013.01)

(58) Field of Classification Search
CPC ..... E21B 49/008; E21B 43/26
USPC ..... 73/38, 152.05, 152.06, 152.41; 166/250.1
See application file for complete search history.

(56) References Cited

U.S. PATENT DOCUMENTS 3,858,658 A * 1/1975 Strubhar et al. ..... 166/308.1
4,860,581 A 8/1989 Zimmerman et al.
4,936,139 A 6/1990 Zimmerman et al.
5,065,619 A * 11/1991 Myska ..... 73/152.24
5,489,740 A * 2/1996 Fletcher ..... 588/250
7,272,973 B2 * 9/2007 Craig ..... 73/200
2007/0272407 A1 * 11/2007 Lehman et al. ..... 166/250.1
2008/0035343 A1 * 2/2008 Odeh et al. ..... 166/293
2010/0006293 A1 * 1/2010 Gu et al. ..... 166/308.2
2010/0256019 A1 * 10/2010 Aston et al. ..... 507/128
2010/0282470 A1 * 11/2010 Alberty et al. ..... 166/308.1

OTHER PUBLICATIONS

Nolte, K.G. et al., After-Closure Analysis of Fracture Calibration Tests, Society of Petroleum Engineers Annual Technical Conference and Exhibition, San Antonio, Texas, Oct. 1997, pp. 1-16, SPE 38676.
Nolte, K.G., Background for After-Closure Analysis of Fracture Calibration Tests, (companion paper to SPE 38676), Society of Petroleum Engineers, pp. 1-23, SPE 39407.
Planning, Executing, and Reporting Pressure Transient Tests, United States Environmental Protection Agency, from http://www.epa.gov/r5water/uic/r5guid/r5_06dr.htm, latest update Oct. 2, 2007, pp. 1-24.
Better simulation plan reduces costs, Schlumberger Case Study, Oct. 2004, Oilfield Marketing Communications, pp. 1-2, 04-FE-144.

* cited by examiner

*Primary Examiner* — John Fitzgerald
(74) *Attorney, Agent, or Firm* — Cathy Hewitt; Kenneth L. Kincaid

(57) ABSTRACT

A method for calculating transmissibility, pore pressure, permeability and/or other properties of a subsurface layer comprising the modeling of the borehole pressure recorded from the time the subsurface layer is fractured by isolating said subsurface layer with a downhole tool, pumping fluid into the subsurface layer and stopping pumping said fluid once the formation is fractured until a pseudo-radial or pseudo-linear flow is reached. It is emphasized that this abstract is provided to comply with the rules requiring an abstract which will allow a searcher or other reader to quickly ascertain the subject matter of the technical disclosure. It is submitted with the understanding that it will not be used to interpret or limit the scope or meaning of the claims.

21 Claims, 2 Drawing Sheets

MEASURING PROPERTIES OF LOW PERMEABILITY FORMATIONS

FIELD OF DISCLOSURE

The present application is generally related to the use of a downhole tool to determine formation properties in low permeability zones of an oil and/or gas well; and more particularly to methods and apparatus associated with the measurement of one or more of permeability, fracture pressure, transmissibility, pore pressure, and other properties in low permeability formations. The methods, systems and apparatus available to measure specific formation properties will be discussed in the present disclosure by ways of several examples that are meant to illustrate the central idea and not to restrict in any way the disclosure.

BACKGROUND OF DISCLOSURE

To assess the economic feasibility of a hydrocarbon reservoir, obtaining estimates of formation properties such as, but not limited to, permeability, pore pressure, and hydrocarbon type (among other properties) are essential. Permeability, porosity and pore pressure of a reservoir needs to be understood to be able to estimate the amount of fluids stored in the reservoir and the rate at which reservoir fluids can be produced. Such reservoir properties need to be measured, derived or otherwise estimated and the accuracy of such properties used during the economic viability study in connection with the commercial exploitation of a reservoir will greatly impact the final outcome. Therefore a reasonable certainty and accuracy of such properties are vital in the successful exploitation of an oil and/or gas well.

Furthermore said accuracy and understanding of such properties becomes more important as the permeability decreases. To put this into perspective, a typical sandstone reservoir might have a permeability measurement on the order of one Darcy wherein an accuracy of +/−10% might not drastically impact the final production of hydrocarbon from the reservoir. Alternatively, the permeability of what are referred to in the industry as hydrocarbon bearing shale reservoirs or tight gas reservoirs are typically on the order of one thousandth of a millidarcy (0.001 md) or lower, wherein a small percentile error may make the difference between a producing interval and a non-producing one.

The industry has perfected numerous ways to measure permeability and pore pressure of a subsurface layer over the years and a person of ordinary skill in the art will have access to multiple literature sources where these methods are explained. Such methods, although routinely and successfully used on a regular basis in medium to high permeability reservoirs, are not viable in reservoirs with low permeability due to the extended period of time needed to reach a stable measurement that is representative to the formation measured. The large majority of the methods used to measure permeability and pore pressure of a formation either inject or withdraw a known volume of fluid from the formation; by plotting the time it takes to reach a stable pressure, this can be measured until stable or extrapolated in time, the pore pressure and permeability to a known fluid can be measured with relatively high accuracy. The challenge in a low permeability formation is that reaching a stable pressure measurement after either injecting or withdrawing a volume of fluid by conventional means will take a large amount of time, rendering the test by conventional means impractical.

One of the conventional approaches to measuring permeability and pore pressure routinely used within the industry uses a wellbore formation tester probe or a dual packer tool, to isolate an interval from the mud column and then reduce the pressure of the isolated zone. This causes fluid to flow from the formation into the isolated volume, now with lower pressure than the reservoir, when the pressure in the isolated volume is equal or about the same as the reservoir pressure, the test stops. The pore pressure is determined from the pressure response during the pressure increase. However, in low permeability formations, such as shales, the fluid flow from the reservoir into the isolated volume is too slow to realistically draw the reservoir pressure down, shut in and allow it to build to a point that reservoir pressure can be estimated in a manageable and economical time frame.

An alternate method used in the industry to estimate pore pressure and permeability is using the injection and "fall-off" technique wherein an interval of the reservoir is isolated, this time using drill pipe or coiled tubing coupled with packers, and fluid is pumped from the surface to create a fracture in the formation. A pressure gauge is positioned either at the surface or downhole to monitor the pressure "fall-off" as fluid leaks off into the formation, either into the rock matrix or into fissures contained within the formation. After the newly created fracture is closed (an event a person skilled in the art will be able to determine by watching a pressure over time plot) the pressure continues to be monitored until a linear or radial flow regime can be identified. An extrapolation to infinite time can then be done to obtain the formation pore pressure. Using this technique of pumping fluid from the surface results in large volumes of fluid being injected into the formation before the pumps at surface can be stopped; taking this into account one can conclude the time needed to achieve a pressure falloff estimation of permeability or pore pressure in low permeability formations is quite long and will typically not be economical.

Another alternate method to overcome the problem of large volumes of fluid being pumped into the formation is to use nitrogen gas to create the fracture and record the pressure fall-off. This method reduces the fall-off time considerably but the times are still on the order of days or weeks to reach an adequately accurate estimation of pore pressure or permeability for low permeability formations such as shale or tight gas reservoirs. Other issues such as injected fluid compressibility errors are also introduced.

SUMMARY OF THE DISCLOSURE

The following embodiments provide examples and do not restrict the breath of the disclosure and will describe means of measuring pore pressure and/or formation transmissibility in low permeability reservoirs. From the formation transmissibility, the reservoir permeability can be determined. These parameters are particularly difficult to determine in low permeability reservoirs such as shale and tight gas reservoirs due to the exceedingly long time required to accurately measure their values. Yet their values are important in determining such things as the amount of fluids stored in the reservoir, and the rate at which reservoir fluids can be produced from the reservoir. These parameters directly impact the economic viability of the development of these resources.

The technique herein disclosed is able to achieve an acceptable result in an economical and manageable manner for the oil and gas industry. A downhole tool, such as a wellbore formation tester, that is fitted with dual packers, one or more pressure recorders and a downhole pump, typically with measurable injection rates, is used. This apparatus set up can typically be manipulated from surface to create a small controlled fracture by pumping a small amount of fluid into the formation and allowing for shut down of the pumping process shortly after the fracture is initiated. By creating this small hydraulic fracture, on the order of inches or feet, and through the recording of the pressure using one or more downhole pressure gauges as the pressure falls-off, it is possible to identify the time when the formation pseudo-radial or pseudo-lineal flow regimes begin. From these regimes, the pressure may then be extrapolated to infinite time (as with the injection and fall off technique) to determine the reservoir pressure and the formation transmissibility, from which a matrix permeability may be estimated.

The time needed to reach formation pseudo-radial or pseudo-linear flow in low permeability formations occurs in a matter of hours, not days or weeks as in the previously discussed methods, resulting in not only substantial time savings for the industry but the acquisition of key parameters that otherwise would not have been practical or economical to measure by conventional methods.

Further features and advantages of the invention will become more readily apparent from the following detailed description when taken in conjunction with the accompanying drawings.

DETAIL DESCRIPTION

In the following detailed description of the preferred embodiments, reference is made to accompanying drawings, which form a part hereof, and within which are shown by way of illustration specific embodiments by which the invention may be practiced. It is to be understood that other embodiments may be utilized and structural changes may be made without departing from the scope of the invention.

Figure 1:
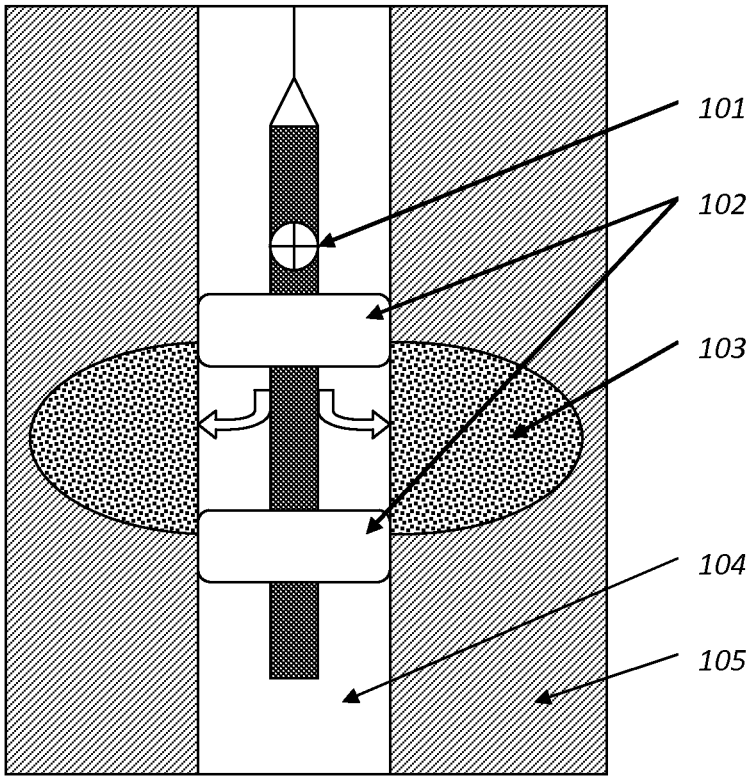
FIG. 1 shows a formation tester with a dual packer injecting fluid into the formation to fracture it and a pressure gauge to record the borehole pressure.

FIG. 1 shows an example of one type of downhole tool, a formation tester, lowered into a wellbore 104 with a dual packer 102, a pump (not shown) for injecting fluid into the wellbore between the dual packers and then into the formation 105 to create a fracture 103, and a pressure gauge 101 for recording the pressure within the wellbore between the straddle packers. Not shown are means for recording a value indicating the volume of fluid pumped into the formation. This could be, for instance, an electronic component located at the surface that records the pumping time if the pump has a fixed pumping rate, could be an electronic component located downhole that measures a piston stroke displacement or other measurement related to the volume of fluid pumped into the formation, etc. This type of formation tester may be, for instance, Schlumberger's Modular Formation Dynamics Tester (MDT™) wireline tool as described in U.S. Pat. Nos. 4,860,581 and 4,936,139, incorporated herein by reference. The downhole tool could be alternatively deployed on slickline, coiled tubing, or drill pipe, or production tubing. If essentially real-time data telemetry exists between the downhole tool and an operator at the surface, the testing sequence described below may be controlled from the surface. Alternatively, the downhole tool may include data processing hardware and software to automate the recognition of fracture initiation, stopping of pumping, and monitoring of pressure in the borehole described in more detail below. The injected fluid will typically consist of borehole fluid that is pumped from either above or below the straddle packers into the contained area between the straddle packers. Alternatively, the fluid may comprise fluid that is transported downhole either with the downhole tool (such as in a sample bottle 106) or while the tool is in place (such as by coiled tubing). By using one of these alternative fluid delivery methods, fracturing fluids of the type typically used in the oilfield services business may be used.

Figure 2:
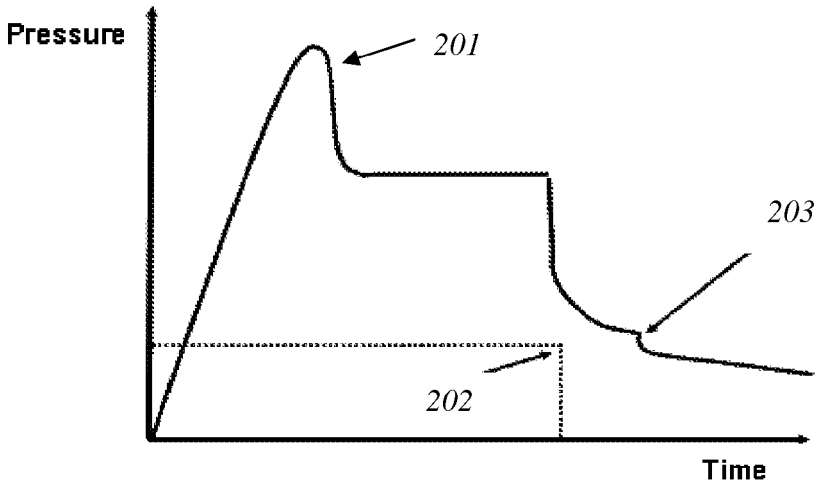
FIG. 2 shows an example pressure and injection rate versus time plot of the testing sequence performed to estimate reservoir pore pressure and formation transmissibility.

FIG. 2 shows an example of the testing sequence performed to estimate reservoir pore pressure and formation transmissibility using the disclosed method; fluid is pumped by the downhole tool into the subsurface formation until a fracture is induced, resulting in a sharp pressure drop 201, once the fracture is extended to the desired length the pumping of the fluid is then stopped 202 and the pressure of the borehole is monitored beyond the time when the fracture is closed 203 until formation pseudo-radial or pseudo-linear flow is achieved. The borehole pressure is monitored by one or more pressure gauges located in the downhole tool until formation pseudo-radial or pseudo-linear flow occurs; with this novel technique the time to reach such formation pseudo-radial or pseudo-linear flow is typically in the range of minutes to hours as opposed of days or even weeks in conventional techniques used so far in low permeability formations. The herein disclosed techniques are preferably used in subsurface formation layers with a permeability of one tenth of a millidarcy (0.1 md) or lower and is particularly preferred when the permeability of the subsurface layer is one thousandth of a millidarcy (0.001 mD) or lower. Once the formation pseudo-radial or pseudo-linear flow is reached, the pore pressure and transmissibility can be estimated if the volume of fluid pumped into the formation is known. A person skilled in the art will be aware of the calculation needed to estimate transmissibility and pore pressure if information regarding the formation pseudo-radial or pseudo-linear flow and volume of fluid pumped is known. This technique is well known in the industry and documented in numerous public papers; documenting such technique is the SPE paper #38676 by K. G. Nolte et al., presented in San Antonio, Tex., US in the annual technical conference and exhibition between the dates of 5-8 of Oct. 1997 under the title "After-Closure Analysis of Fracture Calibration Tests"; a paper on the same subject can be found under the title "Background for After-Closure Analysis of Fracture Calibration tests" by K. G. Nolte presented to the SPE in July 1997 under the number SPE 39407. Both previously mentioned papers, SPE #39407 and SPE #38676, are herein incorporated by reference on its entirety.

The apparent length of the induced fracture is calculated during the analysis described in the previously mentioned papers. It is also possible to follow the test described above with a downhole tool that images or otherwise measures the height of the fracture, such as Schlumberger's FMI™, OBMI™, UBI™, or 3DAIT™ Wireline tools. By using such an actual fracture height measurement, it is possible to calculate permeability from the transmissibility calculated in the method described in the above paragraphs. If the height of the fracture is not measured, the permeability can be estimating by knowing the transmissibility of a formation and estimating the height of the fracture as described in these papers.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice. Further, like reference numbers and designations in the various drawings indicated like elements.

While the invention is described through the above exemplary embodiments, it will be understood by those of ordinary skill in the art that modification to and variation of the illustrated embodiments may be made without departing from the inventive concepts herein disclosed. Accordingly, the invention should not be viewed as limited except by the scope of the appended claims.

The invention claimed is:

1. A method, comprising:

positioning a formation tester in a wellbore adjacent a subsurface layer of a formation, wherein the subsurface layer has a permeability of less than 0.1 millidarcy;

extending packers from the formation tester to isolate an interval of the wellbore adjacent the subsurface layer of the formation;

pumping fluid from a sample bottle of the formation tester into the subsurface layer of the formation through the isolated interval of the wellbore;

inducing a fracture in the formation using the pumped fluid from the sample bottle;

monitoring pressure of the isolated interval of the wellbore until a first drop in pressure is observed corresponding to inducing the fracture;

stopping the pumping of fluid from the sample bottle into the subsurface layer of the formation when the fracture is extended to a predetermined length;

monitoring pressure of the isolated interval of the wellbore until a second drop in pressure is observed corresponding to closure of the fracture;

monitoring pressure of the isolated interval of the wellbore until a formation pseudo-radial or pseudo-linear flow is achieved;

estimating pore pressure and transmissibility of the formation based on the monitored pressure and a volume of the fluid pumped into the subsurface layer of the formation.

2. The method of claim 1 wherein the subsurface layer has a permeability of less than 0.001 millidarcy.

3. The method of claim 1 further comprising:

estimating the length of the fracture; and calculating permeability of the formation based on the estimated length and the estimated transmissibility.

4. The method of claim 1 further comprising:

measuring the length of the fracture with a downhole imaging tool; and calculating permeability of the formation based on the measured length and the estimated transmissibility.

5. The method of claim 1 wherein the fluid is a fracturing fluid.

6. The method of claim 1 wherein pumping fluid and monitoring pressure is controlled from a surface employing real-time data telemetry.

7. The method of claim 1 wherein pumping fluid into the subsurface layer of the formation until the fracture is induced in the formation comprises inducing the fracture to a maximum length on the order of inches or feet.

8. The method of claim 1 wherein the fracture closes and pseudo-radial or pseudo-linear flow is achieved over a period of minutes to hours, but less than days.

9. A method, comprising:

positioning a formation tester in a wellbore adjacent a subsurface layer of a formation, wherein the subsurface layer has a permeability of less than 0.001 millidarcy;

extending packers from the formation tester to isolate an interval of the wellbore adjacent the subsurface layer of the formation;

pumping borehole fluid from the wellbore external to the formation tester, above or below the packers, and external to the interval into the subsurface layer of the formation through the isolated interval of the wellbore;

inducing a fracture in the formation using the pumped borehole fluid from the wellbore external to the formation tester;

monitoring pressure of the isolated interval of the wellbore until both:

the fracture closes; and formation pseudo-radial or pseudo-linear flow is achieved; and estimating pore pressure and transmissibility of the formation based on the monitored pressure and a volume of the borehole fluid pumped into the subsurface layer of the formation.

10. The method of claim 9 further comprising:

estimating the length of the fracture; and calculating permeability of the formation based on the estimated length and the estimated transmissibility.

11. The method of claim 9 further comprising:

measuring the length of the fracture with a downhole imaging tool; and calculating permeability of the formation based on the measured length and the estimated transmissibility.

12. The method of claim 9 wherein pumping borehole fluid and monitoring pressure is controlled from a surface employing real-time data telemetry.

13. The method of claim 9 wherein pumping borehole fluid into the subsurface layer of the formation until the fracture is induced in the formation comprises inducing the fracture to a maximum length on the order of inches or feet.

14. The method of claim 9 wherein the fracture closes and pseudo-radial or pseudo-linear flow is achieved over a period of minutes to hours, but less than days.

15. A method, comprising:

positioning a formation tester in a wellbore adjacent a subsurface layer of a formation, wherein the subsurface layer has a permeability of less than 0.1 millidarcy;

extending packers from the formation tester to isolate an interval of the wellbore adjacent the subsurface layer of the formation;

pumping borehole fluid from the wellbore external to the formation tester, above or below the packers, and external to the interval into the subsurface layer of the formation through the isolated interval of the wellbore;

inducing a fracture in the formation using the pumped borehole fluid from the wellbore;

continuing to pump the borehole fluid from the wellbore into the subsurface layer of the formation through the isolated interval of the wellbore until the fracture is extended to a predetermined length, and then stopping pumping;

monitoring pressure of the isolated interval of the wellbore until both:

the fracture closes; and formation pseudo-radial or pseudo-linear flow is achieved; and estimating pore pressure and transmissibility of the formation based on the monitored pressure and a volume of the borehole fluid pumped into the subsurface layer of the formation.

16. The method of claim 15 wherein the subsurface layer has a permeability of less than 0.001 millidarcy.

17. The method of claim 15 further comprising calculating permeability of the formation based on the predetermined length and the estimated transmissibility.

18. The method of claim 15 further comprising:

measuring the length of the fracture with a downhole imaging tool; and calculating permeability of the formation based on the measured length and the estimated transmissibility.

19. The method of claim 15 wherein pumping borehole fluid, continuing to pump borehole fluid and monitoring pressure is controlled from a surface employing real-time data telemetry.

20. The method of claim 15 wherein the predetermined length is on the order of inches or feet.

21. The method of claim 15 wherein the fracture closes and pseudo-radial or pseudo-linear flow is achieved over a period of minutes to hours, but less than days.

* * * * *